US007520570B2

(12) United States Patent
Sansone et al.

(10) Patent No.: US 7,520,570 B2
(45) Date of Patent: Apr. 21, 2009

(54) TOOL EXTRACTION SYSTEM FOR ROTARY CUTTER DEVICE

(75) Inventors: Dario Sansone, Castello D'Argile (IT); Roberto Rubini, Molinella (IT)

(73) Assignee: Caterpillar Paving Products Inc., Minneapolis, MN (US)

( * ) Notice: Subject to any disclaimer, the term of this patent is extended or adjusted under 35 U.S.C. 154(b) by 484 days.

(21) Appl. No.: 11/187,866

(22) Filed: Jul. 25, 2005

(65) Prior Publication Data

US 2006/0022510 A1 Feb. 2, 2006

(30) Foreign Application Priority Data

Jul. 27, 2004 (EP) ..... 04017694

(51) Int. Cl.
*E21C 35/19* (2006.01)

(52) U.S. Cl. ..... 299/95

(58) Field of Classification Search ..... 299/95
See application file for complete search history.

(56) References Cited

U.S. PATENT DOCUMENTS

| | | | | |
|---|---|---|---|---|
| 62,012 | A * | 2/1867 | Cornelius | 254/21 |
| 1,626,671 | A * | 5/1927 | Enberg | 81/28 |
| 3,008,361 | A * | 11/1961 | Henning | 173/131 |
| 3,498,677 | A * | 3/1970 | Morrow | 299/102 |
| 5,095,604 | A | 3/1992 | Baker | |

FOREIGN PATENT DOCUMENTS

| | | | |
|---|---|---|---|
| DE | 32 23 761 | A1 | 12/1983 |
| DE | 34 01 243 | A1 | 8/1984 |
| EP | 1 045 075 | A2 | 10/2000 |
| EP | 1186744 | A2 * | 3/2002 |
| GB | 729 796 | A | 5/1955 |
| GB | 952 216 | A | 3/1964 |
| WO | WO 2005005119 | A1 * | 1/2005 |

* cited by examiner

*Primary Examiner*—John Kreck
(74) *Attorney, Agent, or Firm*—Finnegan, Henderson, Farabow, Garrett & Dunner

(57) ABSTRACT

In one exemplary aspect, an extraction tool adapted for extraction of a cutting tool holder mounted to a rotary member of a rotary cutting device is disclosed. The extraction tool comprises a tool frame. A first extraction wedge and a second extraction wedge are connected with the tool frame. At least one of the extraction wedges is movably connected with the tool frame. A related method is also disclosed. In another exemplary aspect, a method of extracting a cutting tool from a tool holder of a rotary cutting device comprises the steps of positioning an extraction tool adjacent the tool holder with a first end at a positioned forward of a cutting tool surface that is disposed within the tool holder and with a second end positioned rearward the cutting tool surface, and applying force to the first end of the extraction tool in a direction other than perpendicular to a longitudinal axis.

16 Claims, 3 Drawing Sheets

TOOL EXTRACTION SYSTEM FOR ROTARY CUTTER DEVICE

TECHNICAL FIELD

This disclosure relates to a tool extraction system rotary cutter devices for construction and mining use and, more particularly, to a system adapted to ease removal or extraction of cutting tools and tool holders.

BACKGROUND

Rotary material cutting or milling devices—such as road pavement mills, surface mining machines, or rotary cutter attachments for hydraulic excavators or the like for example—utilize replaceable cutting tools or bits to cut and remove material from a surface. Typically, the cutting tools wear out quickly and are thus replaced frequently and, in heaving cutting or milling operations, cutting tool replacement may be carried out daily. In some cutting or milling devices, the cutting tool is removably mounted in a tool holder that is itself removable mounted to a rotary drum. In such devices, the tool holder also wears out and is replaced, although typically not as frequently as the cutting tool.

Because rotary cutting or milling devices typically carry a large number of cutting tools, ease of tool and tool holder replacement can have an effect on overall efficiency of the device. Removal or extraction of spent tools and tool holder can be particularly time consuming if the removable part is bonded or cold-welded to its supporting structure as a result of repeated impacts during cutting or milling operation. Known systems for removing cutting tools, such as the system described in European Patent Office publication EP 1 045 075, rely on insertion of a wedge member into the tool holder so that the tool can be pushed from the tool holder by striking the wedge with a hammer or similar tool. Likewise, tool holders have traditionally been removable by striking a rear end of the tool holder with an extraction tool to push the tool holder form the drum or a base block mounted on the drum. More recently, however, tool holder extraction systems have been introduced that rely upon wedges acting against grooves formed in a surface of the tool holder. These systems, although effective, are subject to improvement.

For example, known wedge systems for cutting tool removal rely on a wedge member that is hammered upon by a service technician with the wedge extending generally perpendicularly from the tool holder. This arrangement requires the technician to have adequate space to access the wedge and may thus require the technician to work on the tool extraction with the tool and tool holder low to the ground to provide adequate overhead space. Known wedge systems for tool holder remover typically rely upon two separate wedges that are individually driven into extraction grooves formed in a surface of the tool holder. These independent wedges are stuck alternately by the service technician to cause the tool holder to work its way from the drum or base block. Because the wedges are loose and independent, the technician must control each wedge carefully. One solution to this problem is to provide a tool having a pair of wedge pieced fixed to together, but such a tool requires precise alignment of the grooves and the tool.

This disclosure is directed toward overcoming one or more of the problems described above.

SUMMARY OF THE INVENTION

In one exemplary aspect, an extraction tool adapted for extraction of a cutting tool holder mounted to a rotary member of a rotary cutting device is disclosed. The extraction tool comprises a tool frame. A first extraction wedge is connected with the tool frame, the first extraction wedge being adapted for engagement against a first surface of a cutting tool holder. A second extraction wedge is connected with the tool frame in a position spaced from the first extraction wedge, the second extraction wedge being adapted for engagement against a second surface of a cutting tool holder. At least one of the extraction wedges is movably connected with the tool frame.

In another exemplary aspect, a method of extracting a cutting tool holder from a rotary cutting device, comprises the steps of:

(a) simultaneously positioning first and second extraction wedges in an operable position adjacent to the cutting tool holder, each wedge in engagement with an associated surface of the cutting tool holder;

(b) manually holding the first and second extraction wedges in the operable position; and (c) during step (b), alternately applying force to the first and second extraction wedges to extract the tool holder from the rotary member.

In another exemplary aspect, a method of extracting a cutting tool from a tool holder of a rotary cutting device is disclosed. The tool holder is adapted to receive a cutting tool at a forward end of the tool holder with a cutting tool surface disposed within the tool holder. At least one of the tool holder and the cutting tool defines a longitudinal axis. The method comprises the steps of:

(a) positioning an extraction tool adjacent the tool holder with a first end at a position forward of a cutting tool surface that is disposed within the tool holder and with a second end at a position rearward of the cutting tool surface, the second end being positioned within the tool holder and in engagement with the cutting tool surface; and (b) applying force to the first end of the extraction tool in a direction other than perpendicular to the defined longitudinal axis to press the second end of the extraction tool against the cutting tool surface, thereby forcing the cutting tool to move in a forward direction.

Other features and aspects will be apparent from the following description and the accompanying drawings.

DETAILED DESCRIPTION

Reference will now be made in detail to exemplary embodiments that are illustrated in the accompanying drawings. Wherever possible, the same reference numbers will be used throughout the drawings to refer to the same or like parts.

Figure 1:
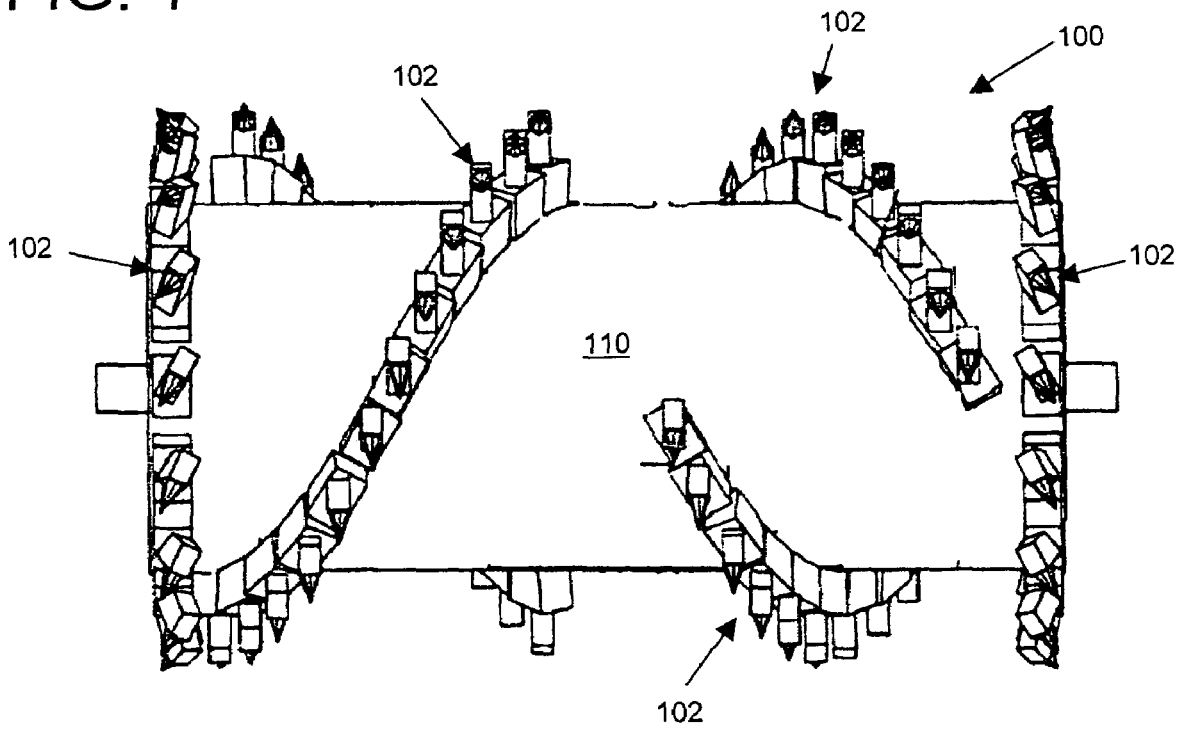
FIG. 1 is an elevational view of an exemplary rotary cutting or milling drum with which a system as disclosed herein may be used.
Figure 2:
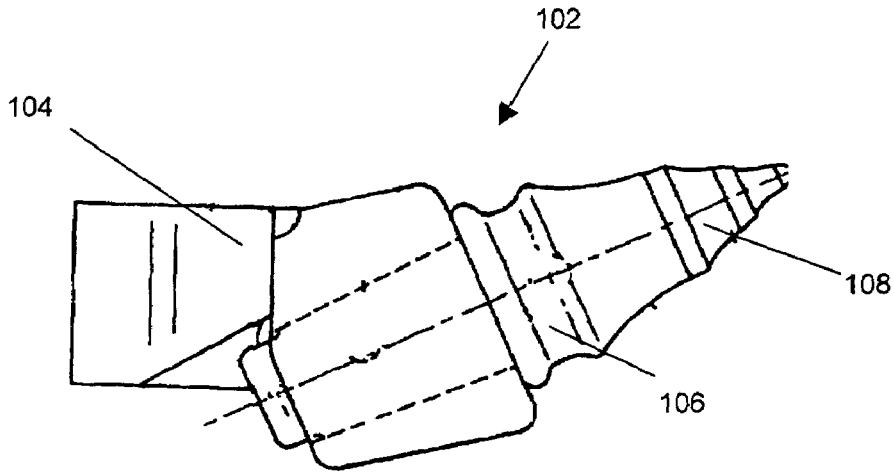
FIG. 2 is a plan view of an exemplary base block, tool holder, and cutting tool of an exemplary cutting or milling drum as shown in FIG. 1.

FIG. 1 illustrates an exemplary rotary cutting device, such as the cutting or milling drum assembly 100 of road pavement mill or surface mining machine (not shown) for example. The drum assembly 100 is rotatable in any suitable manner and includes a suitable pattern of cutter assemblies each designated 102. FIG. 2 illustrates in more detail an exemplary cutter assembly 102. Each cutter assembly 102 may include a base block 104, a tool holder 106, and a cutting tool 108. The base blocks 104 maybe fixed to a cylindrical drum 110 (FIG. 1) by welding but may be removably mounted to the drum 110 in conventional manner or may be integral with the drum 110. The illustrated tool holders 106 are removably mounted to the respective base blocks 104 but maybe integral with or fixed to the base blocks 104 or the drum 110. The exemplary drum assembly 100 and exemplary cutter assembly 102 are shown and described herein solely to aid in understanding of the disclosure. Those skilled in the art will recognize that the disclosed system and tools are may be used with a variety of drum assembly and cutter assembly arrangements as may be or become known in the art.

Figure 3:
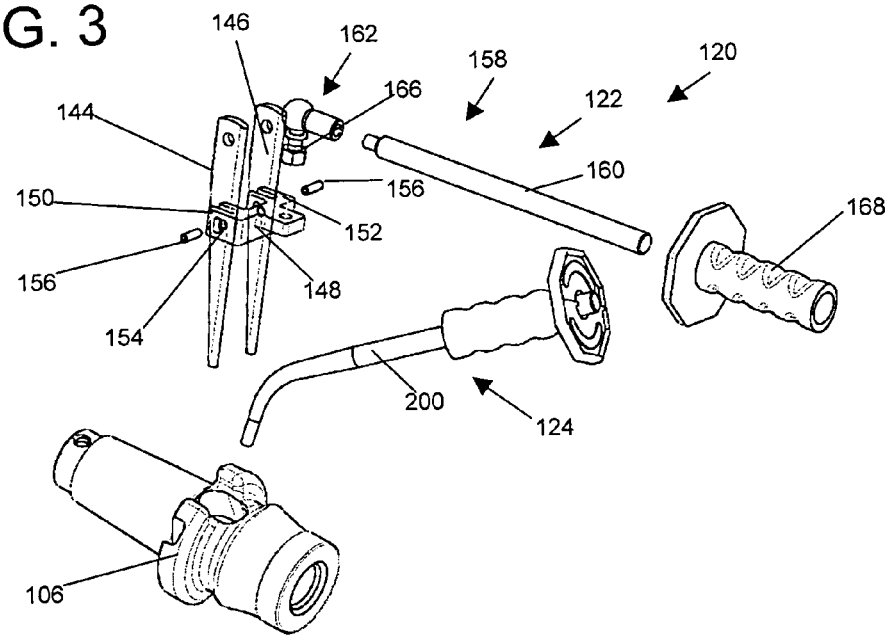
FIG. 3 is a pictorial view of a tool and tool holder extraction system according to this disclosure.
Figure 4:
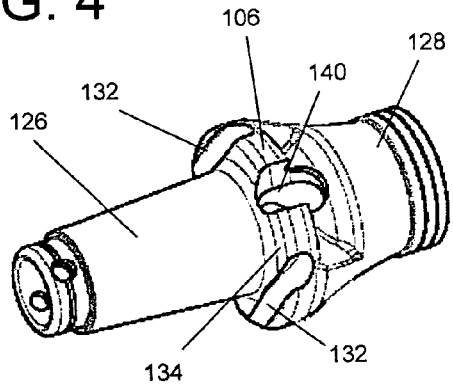
FIG. 4 is a pictorial view of a tool holder according to this disclosure.

FIG. 3 illustrates a wear-part service kit, generally designated 120, for use in extracting worn parts, such as a tool holder 106 and a cutting tool (not shown in FIG. 3) from a milling drum assembly 100 or other rotary cutting device. The kit 120 includes a tool holder extractor, generally designated 122, and a cutting tool extractor, generally designated 124. The kit 120 is particularly useful in connection with a tool holder 106 in accordance with this disclosure as shown in FIGS. 4 through 7. The tool holder 106 and the extractors 122 and 124 will be described below in greater detail.

Figure 5:
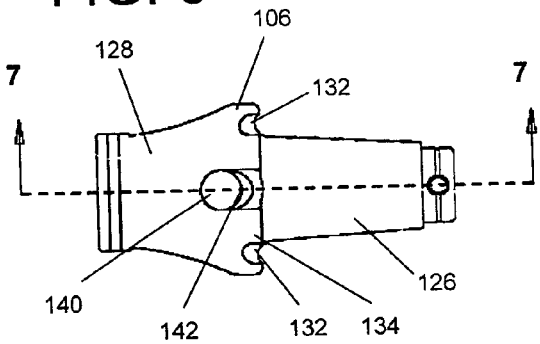
FIG. 5 is an elevational view of the tool holder of FIG. 4
Figure 6:
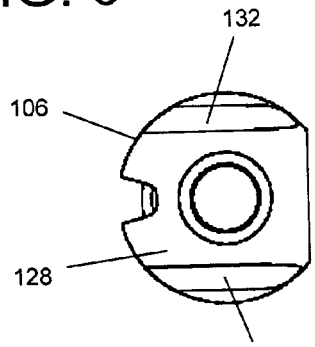
FIG. 6 is an end view of the tool holder.
Figure 7:
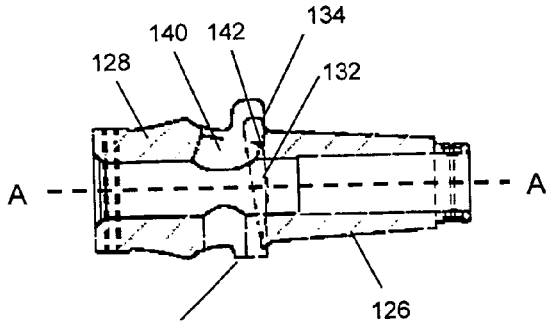
FIG. 7 is a cross-sectional view of the tool holder taken along line 7-7 of FIG. 5.
Figure 9:
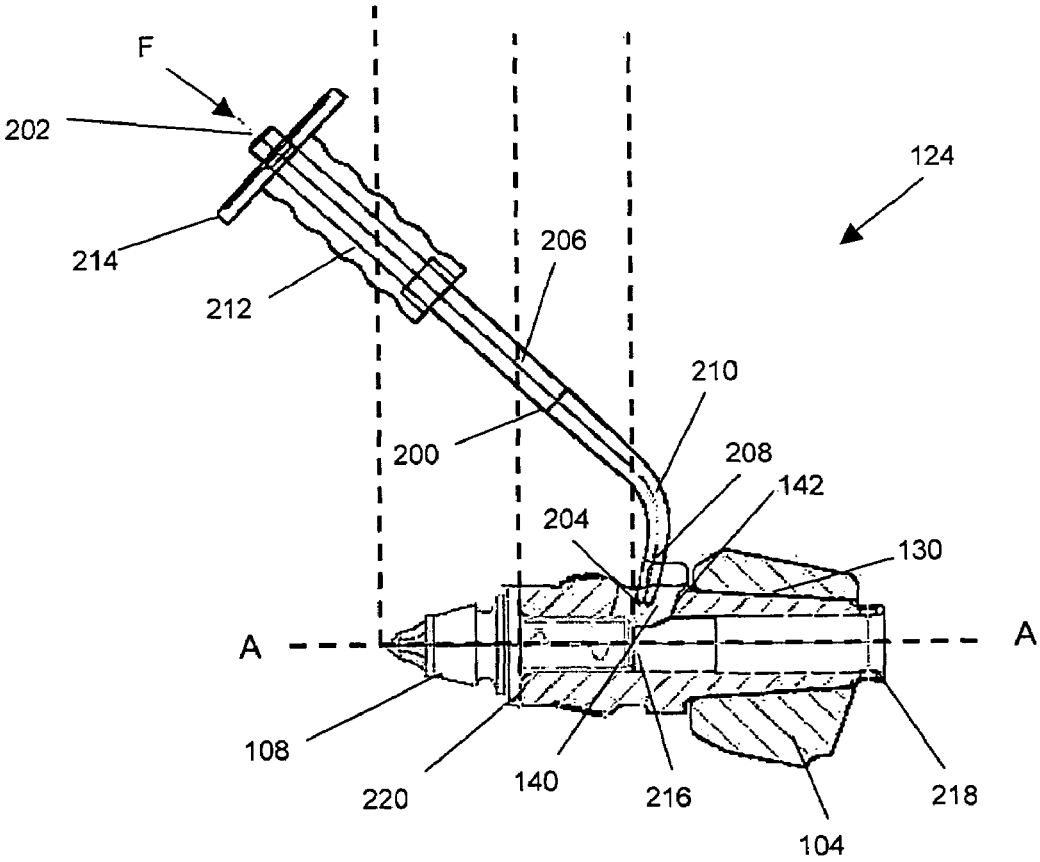
FIG. 9 is a partially cross-section side view of a cutting tool extraction tool and tool holder as shown in FIG. 3.

FIGS. 4 through 7 illustrate a tool holder 106 in accordance with this disclosure. The tool holder 106 may include a tapered body 126 and a receiver 128. The tapered body 126 may be removably received in a tapered tool holder socket 130 as shown in FIG. 9. The tool holder 106 has a longitudinal axis A and may include first and second extraction grooves 132— one on each side of the longitudinal axis A. The groove 132 may be formed in a flange surface 134 that, in use, may engage a confronting surface of the base block 104 or drum 110. As best shown in FIG. 7, the grooves may have a depth that increases as the groove extends across the tool holder. The receiver 128 includes a bore along the axis A adapted to receive the shaft 138 of a cutting tool 108. The tool holder 106 may include a radially outwardly opening slot 140 for receiving a tool extractor such as the tool extractor 124 in accordance with this disclosure. As shown in FIGS. 5, 7, and 9 the slot 140 has a rear wall 142 that lies at an angle other than 90 degrees to the longitudinal axis A of the tool holder 106.

Figure 8:
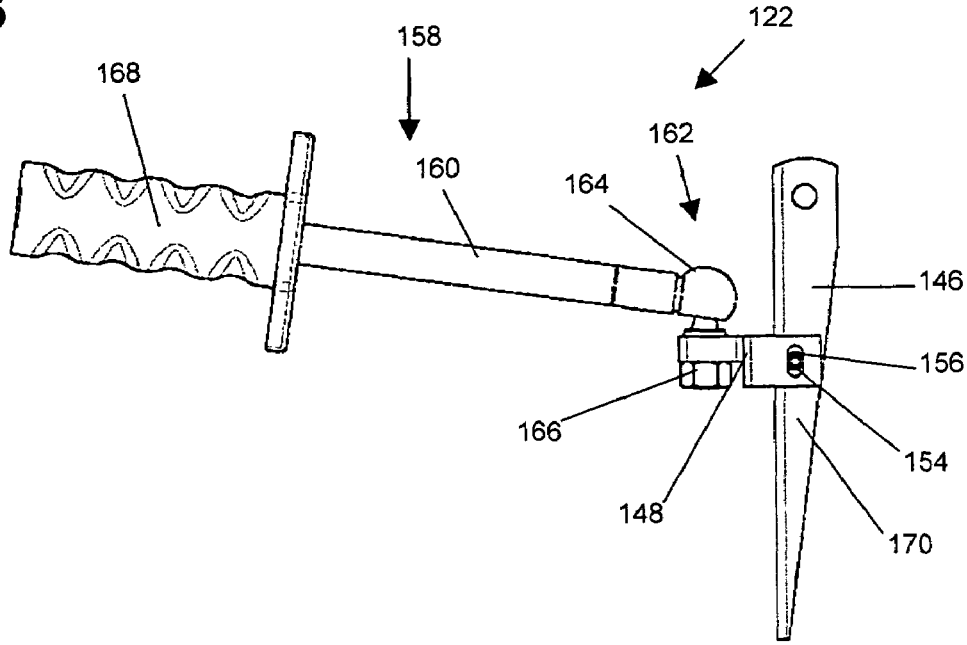
FIG. 8 is a side of a tool holder extraction tool shown in FIG. 3.

FIGS. 3 and 8 illustrate a tool holder extractor 122 in accordance with this disclosure. The tool holder extractor 122 may include a first extraction wedge 144 and a second extraction wedge 146 connected with a tool frame 148. In the embodiment illustrated in FIGS. 3 and 8, each of the extraction wedges 144, 146 is movably mounted to the tool frame 148, but the tool holder extractor 122 may be configured with only one of the extraction wedges 144, 146 movably mounted to the tool frame 148. If one of the extraction wedges 144, 146 is not movably mounted to the tool frame, the non-movable wedge 144, 146 may be integral with the tool frame 148.

The term "wedge" as used herein is intended to encompass both wedge shaped members as shown in the illustrated embodiment and also other members of other shapes that act as wedges due to at least one of their own shape or the shape of interacting portions of the tool holder 106 or base block 104. For example, one skilled in the art will recognize that a member having parallel sides may act as a wedge in the interacting surface of the tool holder 106 or base block 104 extend at an angle to the parallel side of the member. As illustrated in FIGS. 3 and 8, each wedge 144, 146 may have first and second ends, and a central portion adjacent to which the wedge is connected to the tool frame 148.

The tool frame 148 may include a first clevis 150 and a second clevis 152 to which the first extraction wedge 144 and the second extraction wedge 146 are respectively connected. Each extraction wedge 144, 146 may include an elongate slot 154 through which a spring pin, screw, or other suitable fastener 156 extends to secure the associated extraction wedge 144, 146 to its respective clevis 150, 152. As will be discussed below, the elongate slots 154 allow the extraction wedges 144, 146 to pivot relative to the tool frame 148 and also move linearly relative to the tool frame 148. The illustrated connection arrangement is exemplary; other suitable connection arrangements that provide at least one of the pivotal or linear motion between the wedges 144, 146 and the tool frame 148 may be used.

The tool holder extractor 122 may include a handle assembly generally designated 158. The handle assembly 158 may include a shaft 160 connected by a ball joint 162 with the tool frame 148. The ball joint 162 may be conventional and includes a ball (not shown) and socket 164. The ball may be fastened to the tool frame 148 by a fastener, such as nut 166, or welding or other suitable fastening means. The shaft 160 is connected with the socket 164, and a grip 168 formed from plastic, rubber, or other suitable material may be provided on the shaft 160. The ball joint 162 permits the shaft 160 to be swivelable relative to the frame 148 both side to side and also vertically (relative to the position shown in FIG. 8).

As best shown in FIG. 8, each extraction edge 144,146 may have a tapered portion 170 sized to fit into an associated extraction groove 132 in the tool holder 106. The illustrated tapered portions 170 are generally in the shape of a right triangle, but the tapered portions 170 may be in the general shape of an equilateral triangle or any other shape having an increasing lateral cross section as shown in FIG. 8.

FIGS. 3 and 9 illustrate a cutting tool extractor 124 in accordance with this disclosure. The cutting tool extractor 124 includes a shaft 200, which may taper from its first end 202 to its second end 204. The shaft 200 may include a first linear section 206, a second linear section 208, and an arcuate section 210 joining the first and second linear sections 206, 208. FIGS. 3 and 9 illustrate, for example, that the shaft 200 may taper over a portion of the arcuate section 210 and at least one of the first and second linear sections 206, 208. A grip 212 may be provided on the shaft 200 near the first end 202, however the first end 202 of the shaft may remain exposed as shown in FIGS. 3 and 9. The grip 212 may be formed from rubber, plastic, or another suitable material and may include a hand protector 214.

The tool holder extractor 122 may be used as described below when a tool holder 106 reaches a predetermined wear state or otherwise requires removal. The tool holder extractor 122 may be positioned manually adjacent to the tool holder 106, for example by a service technician holding the extractor 122 by the shaft 160 or the grip 168. The first and second extraction wedges 144,146 are thus substantially simultaneously positioned in an operable position in engagement with the extraction grooves 132 of the tool holder 106. The service technician may maintain the extraction wedges 144, 146 in the operable position by use of the handle assembly 158. While the extraction wedges are manually held in place by the handle assembly 158, force is applied alternately to each of the extraction wedges 144,146, meaning that force is applied first to one of the extraction wedges 144,146 and then to the other of the extraction wedges 144,146 rather than simultaneously to both of the extraction wedges 144,146. This force may be applied manually by striking each extraction wedge 144, 146 with a suitable handheld tool such as a hammer. However, a suitable pneumatic, hydraulic, or other automated tool may be used to alternately apply force to each of the extraction wedges 144,146. By alternately apply forces to the extraction wedges 144, 146, the wedges will be driven deeper into the grooves 132, thus causing to the tool holder 106 to move out of the tool holder socket 130. The alternate application of force will cause side loading of the tool holder 106, thus easing breakage of any bonding or cold welding of the tool holder 106 to the socket 130. As apparent, although extraction grooves 132 formed in the tool holder 106 are illustrated, extraction grooves may also be formed in the surface of base block 104 confronting the tool holder 106. In either case, the grooves may receive the extraction wedges 144,146, which are driven deeper into the grooves to thereby force the tool holder 106 from the base block 104.

The pivotal and linear movement of the extraction wedges 144, 146 relative to the tool frame 148 permit easy alignment of the extraction wedges 144, 146 with the grooves 132 in the tool holder 106, which is particularly useful if the grooves 132 are not parallel at the time of tool holder extraction. The swivelable handle assembly 156 may be used by a service technician to hold the extraction wedges 144, 146 in an operable position but the swivel motion permits the shaft 158 or grip 166 to be moved out of the path of the tool used to strike or otherwise apply force to the extraction wedges 144, 146. The tool holder extractor 122 may thus be held in one hand by the service technician while a force-applying tool is operated by the technician's other hand. The disclosed tool holder extractor 122 permits removal of the tool holder 106 from a position entirely forward of the tool holder 106 and without requiring any access to the rear of the tool holder other than simple removal of any rear retention pin (not shown).

With reference to FIG. 9, the cutting tool extractor 124 is shown in an operable position for use in extracting a cutting tool 108 from a tool holder 106. In the operable position of FIG. 9, the first end 202 of the shaft 200 is position forward of an end surface 216 of the cutting tool 108 received within the tool holder 106 and the second end 204 of the shaft 200 is positioned rearward of the end surface 216. As used herein, relative terms such as "forward" and "rearward" are determined in relation to the longitudinal axis A, with "forward" being in a direction from the rear end 218 of the tool holder 106 toward the free or working end 220 of the tool holder 106 and "rearward" being in the opposite direction from "forward". In the illustrated embodiment, the first end 202 of the shaft 200 is positioned forward of the free end 220 of the tool holder 106 and is also positioned forward of the cutting tool 108, as apparent from the dashed vertical lines shown in FIG. 9.

To remove the cutting tool 108, the extractor 124 is held in the operable position shown in FIG. 9 and force is applied to the first end 202 of the shaft 200, as by striking the first end 202 with a hammer or other suitable tool for example. Force applied to the extractor 124, as indicated by arrow F in FIG. 9, is in a direction that is transverse but not perpendicular (i.e. at an angle other than 90 degrees) to the longitudinal axis A defined by the tool holder 106 and the cutting tool 108. The applied force is transmitted to the end surface 216 of the cutting tool 108 to push the cutting tool 108 forward relative to the cutting tool holder 106. The shaft 200 of the cutting tool extractor 124 may bear against the angled bearing surface 142 to facilitate forward movement of the second end 204 of the shaft 200 as the cutting tool 108 is extracted. The disclosed cutting tool extractor 124 may permit removal of the cutting tool 108 from a position forward of the cutting tool 108 and tool holder 108 and may also avoid the need for large clearance around the tool holder 106. Thus, when used together as a kit, the tool holder extractor 122 and the cutting tool extractor 124 may permit replacement of both the tool holders 106 and the cutting tools 108 from a position forward of the tool holders and cutting tools.

It will be apparent to those skilled in the art that various modifications and variations can be made in the disclosed embodiments without departing from the scope of the invention. Other embodiments of the invention will be apparent to those skilled in the art from consideration of the specification and practice of the invention disclosed herein. It is intended that the specification and examples be considered as exemplary only.

What is claimed is:

1. An extraction tool configured for extraction of a cutting tool holder mounted to a rotary member of a rotary cutting device, the extraction tool comprising:

a tool frame;

a first extraction wedge connected to the tool frame, the first extraction wedge including a first end, a central portion, and a second end configured for engagement against a first surface of a cutting tool holder;

a second extraction wedge connected to the tool frame in a position spaced from the first extraction wedge, the second extraction wedge including a first end, a central portion, and a second end configured for engagement against a second surface of a cutting tool holder;

wherein at least one of the extraction wedges is connected adjacent its central portion for pivotal and linear movement relative to the tool frame.

2. The extraction tool of claim 1, wherein each of the first extraction wedge and the second extraction wedge is connected for pivotal and linear movement relative to the tool frame.

3. The extraction tool of claim 1, wherein the at least one wedge connected for pivotal and linear movement relative to the tool frame includes an elongate slot.

4. The extraction tool of claim 1, wherein the at least one wedge is removable from the tool frame.

5. The extraction tool of claim 1, further including a handle assembly extending from the tool frame.

6. The extraction tool of claim 5, wherein the handle assembly is swivelably connected to the tool frame.

7. The extraction tool of claim 5, wherein the handle assembly includes an elongate shaft.

8. The extraction tool of claim 1, wherein the tool frame includes first and second clevises, and wherein the first extraction wedge is connected to the first clevis, and the second extraction wedge is connected to the second clevis.

9. The extraction tool of claim 8, wherein each of the first and second wedges includes an elongate slot, and wherein the extraction tool further includes fasteners connecting each wedge to a respective clevis via one of the elongate slots.

10. The extraction tool of claim 8, wherein the first and second clevises are laterally spaced apart on the tool frame, and a handle assembly is swivelably connected to the tool frame at a position on the tool frame that is centrally located relative to the first and second clevises.

11. A service tool kit for a rotary cutting device, comprising a tool holder extraction tool and a cutting tool extraction tool wherein:

the tool holder extraction tool includes:

a tool frame;

a first extraction wedge connected to the tool frame, the first extraction wedge including a first end, a central portion, and a second end configured for engagement against a first surface of a cutting tool holder;

a second extraction wedge connected to the tool frame in a position spaced from the first extraction wedge, the second extraction wedge including a first end, a central portion, and a second end configured for engagement against a second surface of a cutting tool holder;

wherein at least one of the extraction wedges is connected adjacent its central portion for pivotal and linear movement relative to the tool frame, and the cutting tool extraction tool includes:

an elongated shaft extending from a first end to a second end and including:

a first linear section extending from the first end:

a second linear section extending from the second end: and an arcuate section joining the first and second linear sections, wherein the elongated shaft tapers over a portion of the arcuate section and at least one of the first and second linear sections; and a grip provided on the shaft near the first end.

12. The service tool kit of claim 11, wherein the tool frame of the tool holder extraction tool further includes first and second clevises, and wherein the first extraction wedge is connected to the first clevis, and the second extraction wedge is connected to the second clevis.

13. The service tool kit of claim 12, wherein each of the first and second wedges includes an elongate slot, and wherein the service tool kit further includes fasteners connecting each wedge to a respective clevis via one of the elongate slots.

14. The service tool kit of claim 12, wherein the first and second clevises are laterally spaced apart on the tool frame, and a handle assembly is swivelably connected to the tool frame at a position on the tool frame that is centrally located relative to the first and second clevises.

15. The service tool kit of claim 11, wherein the first end of the shaft is not covered by the grip, and wherein the grip is formed of one of rubber and plastic.

16. The service tool kit of claim 11, wherein the elongated shaft tapers from the first end to the second end.

* * * * *